US005479152A

United States Patent [19]

Walker et al.

[11] Patent Number: 5,479,152

[45] Date of Patent: Dec. 26, 1995

[54] PORTABLE REFRIGERATION DOOR OPEN ALARM APPARATUS

[76] Inventors: Bruce R. Walker, 8279 S. 4800 W., West Jordan, Utah 84088; Marc K. Uhrey, 3576 N. 2900 E., Layton, Utah 84040-8437

[21] Appl. No.: 308,272

[22] Filed: Sep. 19, 1994

[51] Int. Cl.[6] ..... G08B 13/08

[52] U.S. Cl. ..... 340/545; 340/546; 340/693; 62/131; 200/61.62; 200/61.76; 200/61.78; 200/61.81

[58] Field of Search ..... 340/545, 546, 340/585, 586, 693, 517; 62/125, 129, 131; 200/61.62, 61.81, 61.78, 61.76, 61.84

[56] References Cited

U.S. PATENT DOCUMENTS

| | | | |
|---|---|---|---|
| Re. 33,960 | 6/1992 | Prada | 200/61.69 |
| 3,996,434 | 12/1975 | Griffin | 200/61.82 |
| 4,241,337 | 12/1980 | Prada | 200/61.69 |
| 4,438,428 | 3/1984 | Ober et al. | 340/546 |
| 4,528,558 | 7/1985 | Steers | 340/585 |
| 4,566,285 | 1/1986 | Tershak | 340/585 |
| 4,691,195 | 9/1986 | Sigelman | 340/585 |
| 4,894,643 | 1/1990 | Thompson | 340/585 |
| 4,977,392 | 12/1990 | Loda | 340/546 |
| 5,072,212 | 12/1991 | Sorenson | 340/546 |
| 5,341,123 | 8/1994 | Schuman, Sr. et al. | 340/546 |

*Primary Examiner*—John K. Peng
*Assistant Examiner*—Benjamin C. Lee

[57] ABSTRACT

A completely self-contained and portable alarm system that senses a condition in which a refrigerator or freezer door is not fully closed using a plurality of spring-tempered metallic sensor switches and which provides an audible tone from a piezoelectric transducer. By means of a selector switch, the alarm can occur either immediately upon opening the appliance door, after a predetermined delay has expired, or the alarm can be disabled by removing power from the electronic circuit. Compared to other refrigeration alarm systems this invention is not integral to the appliance itself; it senses only door-ajar conditions; is powered by common direct current means; and its mounting location is highly flexible. It can be easily installed by magnetic means on either side, or top of the appliance near the door by simply placing it where desired, accommodating a large number of new as well as older appliance models. Since this invention does not depend on sensing a temperature change within the appliance, the audible door-ajar warning can be given before internal temperatures change substantially, allowing the undesirable condition to be remedied much earlier than would be the case if temperature sensing were done, thus helping to prevent loss of perishables and to save energy.

1 Claim, 5 Drawing Sheets

PORTABLE REFRIGERATION DOOR OPEN ALARM APPARATUS

BACKGROUND—FIELD OF THE INVENTION

This invention relates to sensing when a refrigerator or freezer appliance door has not been fully closed and providing an audible alarm so that the undesirable condition can be quickly remedied.

BACKGROUND—DESCRIPTION OF PRIOR ART

Although sensing door-ajar conditions is not a new concept, a simple, inexpensive, portable alarm system that is not integral to the appliance as originally manufactured and can be easily installed by someone who is not technically adept has yet to appear on the market prior to the present invention.

In the majority of prior art techniques observed, the door-ajar alarms are either designed into the refrigeration appliance by the Original Equipment Manufacturer (OEM), or are installed as "after-market" devices by qualified installation personnel. These alarm systems are generally costly, difficult to install, and in most cases are unattractive to the owners of refrigeration appliances.

In numerous prior art approaches to the problem, temperature sensing is combined with door-ajar sensing to form the basis of the alarm condition. Since these approaches often require constant current flow to operate the sensing circuitry, Alternating Current (AC) is the power means of choice, and the sensing circuitry is often quite complex, rendering the device rather costly to the consumer. Further, installation of these devices ostensibly must be done either at the time of manufacture of the appliance, or by qualified installation personnel at a later date.

In U.S. Pat. No. 4,894,643, the sensing mechanism consists of a thermistor in a heat transfer arrangement with the refrigeration compartment light bulb. In this system, the alarm condition is dependent upon reliable operation of both the light bulb and its actuating switch. If either fails, the alarm will not be sounded if a door-ajar condition should exist.

In U.S. Pat. No. 4,566,285, a microprocessor is used to sense and decipher various alarm conditions. This is rather complex and is ostensibly built into the appliance by the OEM.

In U.S. Pat. No. 4,528,558, a switch requires a manual actuating element to sense whether the appliance door is wide open, closed, or ajar, and the alarm system requires installation at the time of appliance manufacture.

In U.S. Pat. Nos. 4,241,337 and RE 33,960, Hall Effect switches and reed switches are used to sense the position of the magnetic strip on the door relative to the refrigeration compartment.

This alarm system is ostensibly installed by the OEM at the time of manufacture of the appliance.

An after-market solution is proposed in U.S. Pat. No. 4,691,195, which has the disadvantage of being far more difficult to install than the present invention, requiring a sensitivity adjustment which might be performed improperly by, or present difficulty to an unskilled person, and requiring permanent or semi-permanent attachment to a typical refrigeration appliance, making removal thereof difficult on a typical refrigeration appliance, and being somewhat complex.

In another approach, disclosed in U.S. Pat. No. 3,996,434, the sensing mechanism consists of an actuating plunger and holding element for activating and deactivating the alarm system.

In each prior art case observed, these alarm systems require installation by the appliance manufacturer or by qualified personnel for "after market" installations.

A need exists for an inexpensive alarm system that can be easily attached in a non-permanent manner to a refrigerator or freezer appliance by a person without technical skills, and that has a high degree of flexibility as to mounting location on the appliance. The need also exists for an alarm system that senses only door-ajar conditions, and that can be powered by readily available low cost direct current means, such as a 9-volt battery, which will not cause the alarm system to be dependent upon AC power which is known to fail from time to time during "brown outs" and "black outs". When AC power does fail, a door-ajar alarm system becomes all the more important, because without AC power, the refrigeration compressor will not function, and the temperature inside the refrigeration compartments will rise more quickly, especially when the doors are open. Further, there is a need for a device that will remain operable for an extended period of time with minimal operator intervention, and that is capable of generating an alarm immediately upon opening the appliance door, for example, to help a mother with toddlers to monitor their activity for their safety and to prevent spills, or to generate an alarm after a predetermined delay in order to allow normal use of the refrigerator without nuisance alarms being generated.

While other inventions do exist that partially address these needs, none of the prior art techniques observed fill all the needs herein listed. The preferred invention fills these, and other present needs.

OBJECTS AND SUMMARY

It is therefore an object of this invention to make available a simple and inexpensive refrigeration alarm system that is easy to install and can be done by the end user.

It is also an object to provide an alarm system that is fully self-contained in a small area, and that has a high degree of flexibility as to mounting location on the appliance, so as to accommodate a wide variety of new and older appliance models.

Other objects include: CMOS circuitry that is low power for extended operational life; readily available direct current power means, such as a 9-volt battery; simple means of detecting door-ajar conditions, such as spring wires comprising sensor switches.

This invention makes available refrigeration door-open warning systems to many who would either be unable to afford the more costly alternatives, or those who are unskilled in proper installation methods of alarm systems that are more complex.

DESCRIPTION OF THE BLOCK DIAGRAM

Figure 1:
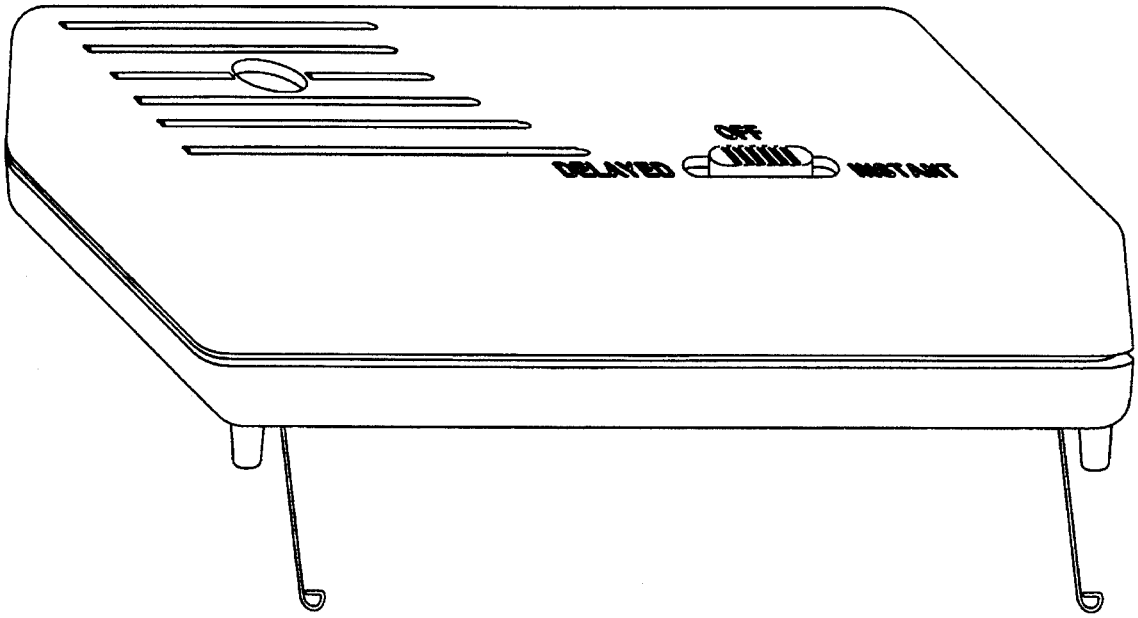
FIG. 1 is a perspective view of the preferred embodiment, illustrating the alarm enclosure, delay selection switch, spring wires, and positioning tabs.
Figure 2:
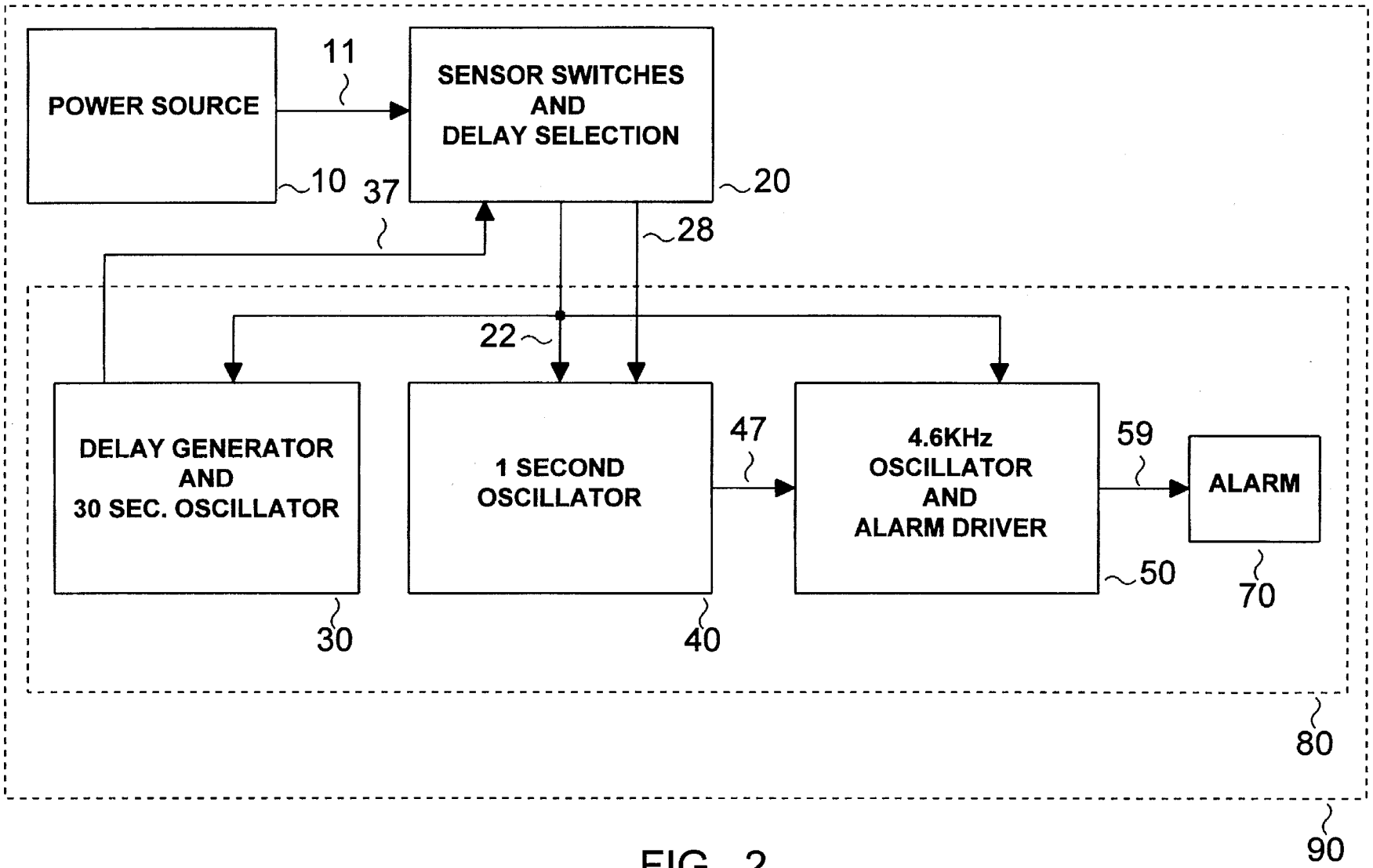
FIG. 2 is a functional block diagram of the preferred embodiment of the present invention.

Refer to FIG. 2. Power Source 10 provides direct current power 22 to blocks 30, 40 and 50 when either of two door sensor switches in 20 is closed. Depending upon the position of the Delay Selection Switch in 20, 40 will either oscillate independently of 30, or be logically ANDed with 30.

If delay selection in 20 allows independent operation of 40, when power is applied 40 will immediately begin to oscillate at a frequency of approximately 1 Hz with a corresponding period of 1 second. The output of 40 (47) will in turn allow 50 to oscillate at approximately 4.6 KHz when 47 is true. The output of 50 (59) drives 70, a piezo-electric transducer which generates an audible tone. Since 47 alternates from true to false every half second, 50 will correspondingly be allowed to oscillate for half of each period when 47 is true. When 47 is false, 50 is prevented from oscillating. Thus, an audible tone pulsating at a rate of approximately ½ second on and ½ second off is generated when delay selection in 20 allows independent oscillation of 40, and either sensor switch in 20 is closed.

When delay selection in 20 causes a logical AND of 30 and 40, 40 and 50 will be prevented from oscillating until the output of 30 (37) goes true, following a time delay of approximately 1 minute. When 37 goes true, 40 is allowed to oscillate at its 1 Hz rate, and 50 will in turn be allowed to oscillate at 4.6 KHz in the same manner as described previously.

If power is not removed by opening both sensor switches in 20, then 40 and 50 will continue to oscillate at their respective rates, generating a pulsating alarm until 37 goes false approximately 30 seconds after it went true. When 37 becomes false, 40 and 50 are prevented from oscillating, and the alarm is silenced until 37 again goes true, approximately ½ minute later. Low frequency oscillator 30 will continue to switch from true to false every 30 seconds until power is removed.

DETAILED DESCRIPTION

Figure 4A:
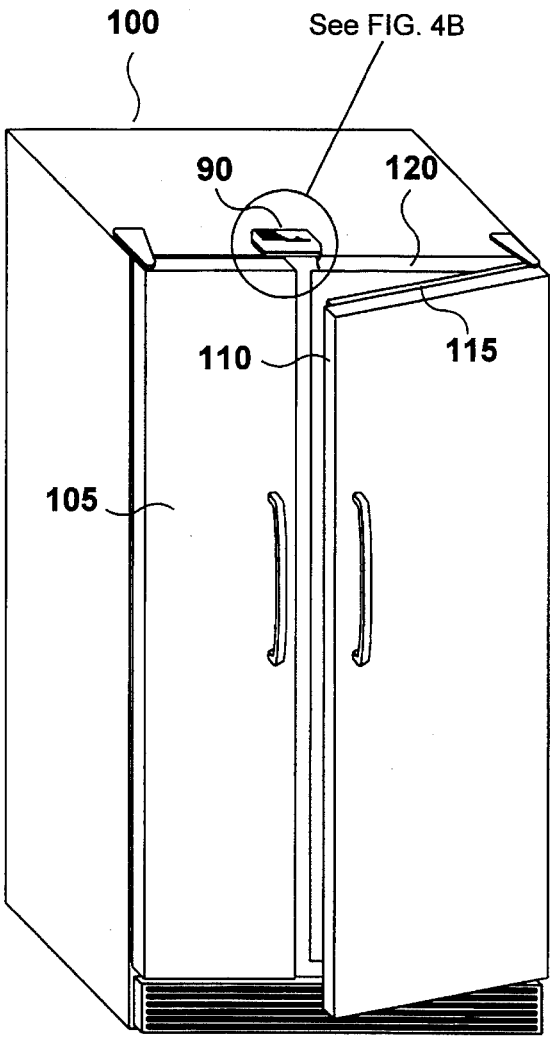
FIG. 4A is a perspective view of the present invention installed on a refrigerator/freezer appliance with side-by-side storage compartments.
Figures 5A, 5B:
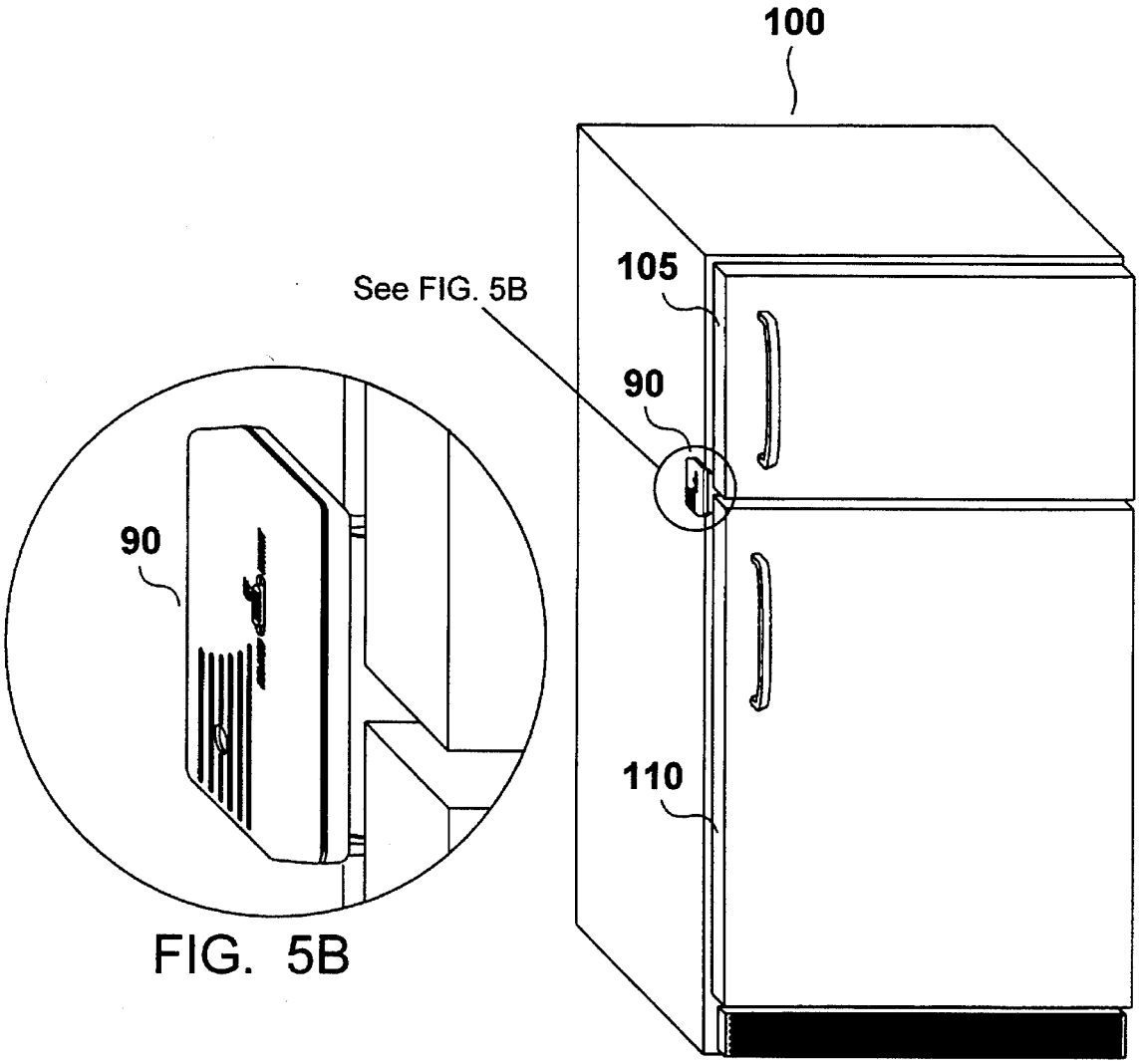
FIG. 5A is a perspective view of the alarm invention installed on a refrigerator/freezer appliance with vertically aligned storage compartments.
FIG. 5B is an expanded perspective view of the present invention installed on the appliance shown in FIG. 5A.

For the discussion that follows, it is useful to describe the invention in terms of being installed on a combination refrigerator/freezer appliance 100, which has two doors, one for the refrigerator compartment 110, and one for the freezer compartment 105 as shown in FIGS. 4A and 5A.

Figure 3:
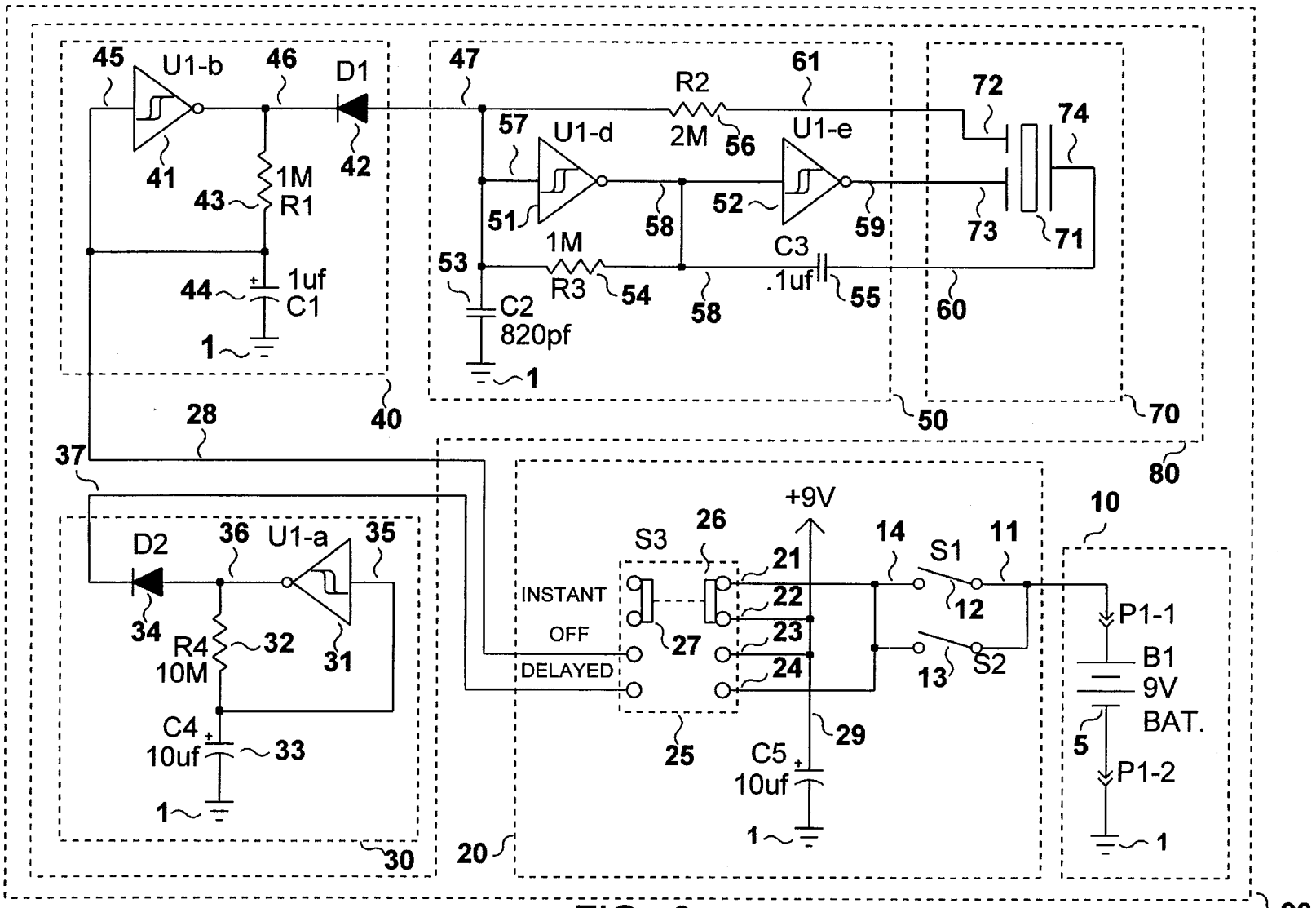
FIG. 3 is a schematic diagram illustrating the electronic components contained within each respective block shown in FIG. 2 for the preferred embodiment.

Referring to FIG. 3. A 9-volt battery 5 or other direct current power source provides power to the electronic circuitry when either switch S1 or S2 is closed and switch S3 is not in the OFF position. With the alarm system installed on a refrigeration appliance, and the appliance door closed, S1 and S2, which are comprised of spring wires, are normally compressed between the door strip 115 of the appliance and the cabinet face 120, causing both switches S1 and S2 to be open. In this instance, no power is applied to any of the electronic circuitry 80, and thus, no current is drawn from the battery 5.

Referring again to FIG. 3, the combination of wires 12 and 14 form switch S1, while 13 and 14 form S2. S1 and S2 are connected in parallel, thus, if either appliance door is opened and S3 is in either INSTANT or DELAYED position, the spring wire 12 or 13 at the open door position will be allowed to spring into a position in which it comes into contact with the wire at 14. This will complete the circuit from 11 to 14, and direct current (DC) power will be applied to the electronic circuitry, causing it to be energized.

If switch S3 is in the INSTANT position 28 will not be connected to 37, and when a door 105 or 110 is opened, block 40 will begin to oscillate. 40 is comprised of U1-b, D1, R1, and C1. Since, at initial application of power to U1, C1 is discharged, 45 will be low and 46 will be high. Thus, D1 cathode will be high, presenting a high impedance at 47 to R2, U1-d, R3, and C2. Block 50 forms an oscillator and driver for the piezoelectric transducer 70. Since its construction is fairly commonly known and is discussed in various commercial literature, its operation will not be described here. Block 50 comprised of U1-d and U1-e, R2, R3, C2, and C3, will begin to oscillate at approximately 4.6 KHz, driving piezoelectric transducer 70 at 73, causing an audible tone to be generated. This condition will continue until 46 goes low. While 46 is high, C1 begins to charge through R1, the two of which create an RC time constant which determines, in part, the oscillation frequency of 40. U1 is a CMOS Schmitt Trigger inverter. When C1 charges to the input switching threshold at 45, U1-b output at 46 will switch low. C1 then begins to discharge through R1 to 46, which is near ground potential. Because D1 cathode at 46 is now also near ground, any voltage at 47 which exceeds one diode drop (approximately 0.6 V) greater than the voltage at 46 will see a low impedance path to ground at 46. Thus, 57 is held low and 50 is prevented from oscillating, causing the piezo alarm 70 to be silenced. This condition will continue until C1 has discharged sufficiently to overcome the input hysteresis of U1-b, at which time 46 will again switch high and 50 will start to oscillate. The oscillation frequency of 40 is a function of the RC time constant of R1/C1 as well as the hysteresis levels of U1-b. In the preferred embodiment, the oscillation period is set to be approximately 1 second, so the alarm will repetitively sound for ½ second and be silent for ½ second until power is removed from the circuit 80 by closing both appliance doors 105 and 110, opening both S1 and S2.

If S3 is in the DELAYED position, then 28 is connected to 37 and oscillator block 30 is effectively logically ANDed with 40. Low frequency block 30 is comprised of U1-a, R4, C4, and D2. When an appliance door 105 or 110 is opened either S1 or S2 is closed and the circuit 80 is energized as described previously. At application of power, C4 is initially discharged, holding 35 low. 36 will thus be high. Since D2 anode is high, its cathode will also tend to go high, except that C1 is initially discharged, so 37 will be held at the same voltage as 45. Diode D2 will therefore be forward biased, and current will flow through the diode, assisting 46, which is high, in charging C1. This happens rather quickly, since 37 has a much lower impedance than R1. Thus, when DELAYED mode is selected and a door opened; a very short "chirp" may be heard from the alarm system, which serves to indicate that it is operational and power is applied to the circuit 80.

After C1 has charged sufficiently for 46 to switch low, 37 will tend to hold 45 high by U1-a providing enough current through D2 at 37 to prevent C1 from discharging. 45 will be held high as long as C4 continues to charge through R4 until 35 reaches the input switching threshold of U1-a. At that point, U1-a output at 36 will switch low, causing D2 to be reverse-biased and cutting off the current flow from 36 to 45. This allows C1 to begin discharging through R1. R4 and C4 values are selected to provide a delay time of approximately 1 minute before 36 switches. Thus, in DELAYED mode, the alarm is prevented from sounding except an initial soft "chirp" until approximately 1 minute has passed.

When C1 discharges sufficiently for a valid low level input to be seen at 45, U1-b output at 46 will switch low, and the alarm will begin to sound repetitively every ½ second as described previously. This condition will continue until power is removed from the circuit by closing the appliance door, or until U1-a switches high at 36 as a result of C4 discharging through R4 to 36, while 36 was low. If power is not removed from the circuit, 36 will switch from high to low approximately every 30 seconds. The oscillation frequency is a function of the RC values of R4 and C4 and the hysteresis levels of U1-a.

Thus, when DELAYED mode is selected and power is applied to the circuit, the alarm will be silent for approximately 1 minute, except for an initial soft "chirp", then the alarm will repeatedly pulse on and off every ½ second for about 30 seconds, then be silent for 30 seconds until power is removed from the circuit by closing a door. Pulsating the alarm has the benefit of more easily commanding one's attention, as well as saving battery power, especially during the 30-second silent portion of the alarm duty cycle.

If S3 is in the OFF position, DC power will be prevented from being applied to the electronic circuit 80, regardless of whether S1 or S2 are open or closed.

Figure 4C:
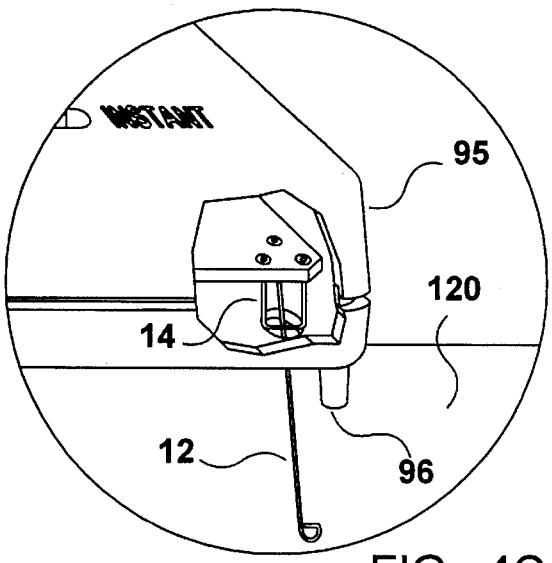
FIG. 4C is an expanded cut-away view of the present invention, illustrating a spring wire and wire contact, comprising a single door position sensor switch.
Figure 4B:
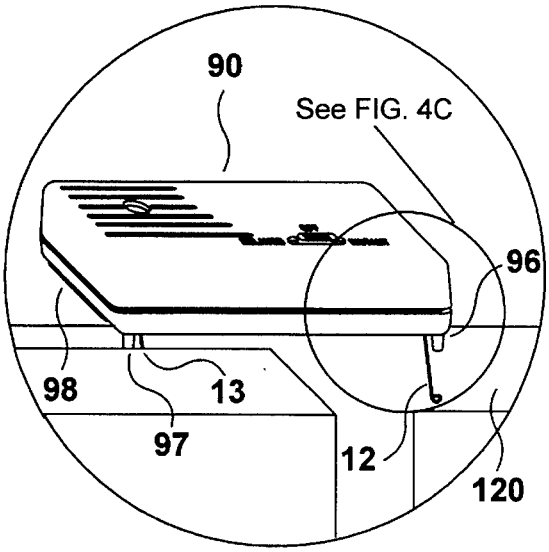
FIG. 4B is an expanded perspective view of the door-ajar alarm invention.

Referring to FIGS. 4A, 4B, and 4C, the self-contained alarm system is shown in a typical installation on an appliance with side-by-side refrigerator and freezer compartments. The alarm unit 90 is attached to the top of the appliance 100 using magnetic means 98, which is permanently adhered to the rear surface of the enclosure 95.

The alarm unit 90 is positioned such that alignment tabs 96 and 97 contact the appliance chassis 120 near the compartment openings for each respective door 105 and 110; also such that sensor switch 13 will be compressed upon closure of door 105, and sensor switch 12 will be compressed upon closure of door 110. Thus, in the preferred embodiment, each compartment door position is sensed independently with a single self-contained alarm unit.

FIGS. 5A and 5B illustrate installation of the alarm unit 90 on a refrigeration appliance having one compartment atop the other and right-hand opening doors 105 and 110. For left-hand opening doors, the alarm unit 90 would be installed on the right-hand side of the appliance 100 and rotated 180° about a vertical axis through the alarm unit 90 so that the sensor switches 12 and 13 face the front of the appliance.

While the preferred embodiment describes in detail one implementation of the present invention, other additions, applications, or modifications will be obvious to those skilled in the art and can be implemented without departing from the spirit and scope of this invention.

We claim:

1. A self-contained and portable means of sensing refrigerator or freezer appliance door-ajar conditions for one or two appliance doors and producing an audible alarm, comprising:

a portable direct current power source of known construction;

a low power electronic circuit;

two electromechanical sensor switches, each consist of a movable spring-tempered wire contact and a stationary contact, to sense door-ajar conditions for two appliance doors, each said movable spring-tempered contacts inserted exteriorly between a respective appliance door and the appliance chassis thereof to perform the following functions:

when the appliance doors are closed, the respective movable contacts are pressed away from and break connection with their respective stationary contacts to thereby disconnect power from said electronic circuit;

when either or both appliance doors are opened, the respective movable contact(s) is allowed to flex toward the respective stationary contact(s) to thereby make connection with the respective stationary contact(s), thereby applying power to and energizing said electronic circuit;

an integral alarm for producing an audible tone in response to energyzation of said electronic circuit;

a single enclosure containing said direct current power source, said low power electronic circuit, said sensor switches, and said integral alarm, and which provides a means of removably attaching said enclosure on an exterior surface of the appliance chassis without the use of tools or permanent adhesives thereby allowing portability.

* * * * *